US010994922B2

(12) United States Patent
Kanno

(10) Patent No.: US 10,994,922 B2
(45) Date of Patent: May 4, 2021

(54) METERING VALVE MECHANISM OF AEROSOL CONTAINER AND AEROSOL TYPE PRODUCT WITH SAID METERING VALVE MECHANISM

(71) Applicant: MITANI VALVE CO., LTD., Tokyo (JP)

(72) Inventor: Hiroshi Kanno, Tokyo (JP)

(73) Assignee: MITANI VALVE CO., LTD., Tokyo (JP)

( * ) Notice: Subject to any disclaimer, the term of this patent is extended or adjusted under 35 U.S.C. 154(b) by 0 days.

(21) Appl. No.: 16/965,202

(22) PCT Filed: Dec. 11, 2018

(86) PCT No.: PCT/JP2018/045440
§ 371 (c)(1),
(2) Date: Jul. 27, 2020

(87) PCT Pub. No.: WO2019/146289
PCT Pub. Date: Aug. 1, 2019

(65) Prior Publication Data

US 2021/0061544 A1 Mar. 4, 2021

(30) Foreign Application Priority Data

Jan. 29, 2018 (JP) ..... JP2018-012937

(51) Int. Cl.
*B65D 83/54* (2006.01)
*B65D 83/48* (2006.01)
*B65D 83/42* (2006.01)

(52) U.S. Cl.
CPC ..... *B65D 83/546* (2013.01); *B65D 83/42* (2013.01); *B65D 83/48* (2013.01)

(58) Field of Classification Search
CPC ..... B65D 83/42; B65D 83/425; B65D 83/48; B65D 83/52; B65D 83/54; B65D 83/546; B65D 83/60; B65D 83/64; B65D 2547/00
See application file for complete search history.

(56) References Cited

U.S. PATENT DOCUMENTS 3,176,887 A * 4/1965 Potapenko ..... B65D 83/54 222/402.2
3,180,535 A * 4/1965 Ward ..... G01F 11/04 222/335

(Continued)

FOREIGN PATENT DOCUMENTS

JP 2003-118784 A 4/2003
JP 2008-207873 A 9/2008

OTHER PUBLICATIONS

PCT, International Search Report for the corresponding patent application No. PCT/JP2018/045440, dated Feb. 5, 2019, with English translation.

*Primary Examiner* — Patrick M. Buechner
*Assistant Examiner* — Randall A Gruby
(74) *Attorney, Agent, or Firm* — Lucas & Mercanti, LLP

(57) ABSTRACT

An aerosol dispenser having a metering valve mechanism having a metering chamber and a propellant-accommodating space region configured to be isolated from each other by an annular piston, and a metering formation seal valve configured to isolate the metering chamber from a contents accommodation space region in a propelling mode. In a contents filling mode the seal valve is moved by the flow of the filled contents in a direction away from the stem to allow the filled contents to flow into the contents accommodation space region.

5 Claims, 4 Drawing Sheets

(56) References Cited

U.S. PATENT DOCUMENTS 4,577,784 A * 3/1986 Brunet ..... G01F 11/04
222/389
5,881,925 A * 3/1999 Ando ..... B05B 11/0078
222/190
8,893,933 B2 * 11/2014 Ohshima ..... B65D 83/285
222/402.13

* cited by examiner

METERING VALVE MECHANISM OF AEROSOL CONTAINER AND AEROSOL TYPE PRODUCT WITH SAID METERING VALVE MECHANISM

CROSS REFERENCE TO RELATED APPLICATION

This Application is a 371 of PCT/JP2018/045440 filed on Dec. 11, 2018 which, in turn, claimed the priority of Japanese Patent Application No. 2018-012937 filed on Jan. 29, 2018, both applications are incorporated herein by reference.

FIELD OF THE INVENTION

The present invention relates to a metering valve mechanism that uses the closing action of a metering chamber formation seal valve based on the shift of a stem in an inner housing from a stationary mode to a propelling mode to shut off a metering chamber consisting of an inner housing and an outer housing and a contents accommodation space region at the upstream side thereof.

This contents accommodation space region corresponds to a BOV (Bag-On-Valve)-type inner bag attached to the outer housing side for forming the metering chamber, for example.

The contents accommodation space region is provided in an outer annular space region constituting a metering chamber between an inner housing outer peripheral surface and an outer housing inner peripheral surface to provide the complete sealing property of an annular piston to push out the contents of the metering chamber to the stem (outer space region), for example and the outer peripheral surface and the inner peripheral surface when the contents are filled.

To-be-propelled contents are received by the metering chamber via the above-described seal valve. The contents of the metering chamber are propelled from the inner housing-side stem path to the outer space region by the pushing action of the annular piston moved by the propellant pressure in a seal valve-closed state so as to reduce the accommodation space region.

The metering valve mechanism of the present invention is configured, when contents are filled respectively in the metering chamber and the contents accommodation space region (inner bag) at the upstream side thereof, the strength of the flow of the contents causes the above-described seal valve to be set in an opened state in a forced manner, for example.

The metering chamber includes a lower face part of the above-described annular piston as a constituting member, for example. The lower face part receives a high pressure from the filled contents flowing into the metering chamber (the inner annular space region and the outer annular space region). On the other hand, an opposite face to the face constituting the metering chamber of the annular piston (e.g., the upper face part) receives the pressure from the propellant accommodated in the container body.

The present invention intends to provide the secure sealing between the annular piston, the inner housing outer peripheral surface and the outer housing inner peripheral surface, respectively, in this contents filling mode.

By securing the sealing of the annular piston, the contents filled in the outer annular space region as a metering chamber are prevented from being leaked from the sealing action part of the annular piston to the propellant-accommodating space region exterior to the metering chamber.

In the contents propelling mode, the contents accommodated in the metering chamber are moved by the lower move of the annular piston having received the propellant pressure so that the contents are generally moved to the lower side in an outer annular space region to subsequently move in an inner annular space region in a direction from the lower end part to the upper side and are allowed to flow into the stem path.

As described above, the contents accommodated in the metering chamber are moved to the stem path to form a U-shaped path. Thus, the gas phase of the upper end of the outer annular space region is finally propelled from the metering chamber to the outer space region, for example.

Specifically, undiluted solution at the lower side of this gas phase is allowed to flow to the outer space region after which the propellant such as compressed gas or liquefied gas steam is propelled, for example. Thus, the undiluted solution may be drained in a preferred manner.

BACKGROUND ART

The applicant of the invention suggests, as a metering valve mechanism of an aerosol container,

(11) a valve mechanism that consists an inner annular space region for accommodating a stem and the outer annular space region thereof. The outer annular space region has an annular piston that is a component of the metering chamber to move by the pressure action by the propellant. The move of this annular piston causes the contents of the metering chamber to be pushed out to the outer space region (see FIG. 3 of Patent Publication 1).

(12) The applicant of the invention suggests a valve mechanism that has a seal valve providing a valve action with the stem in the housing to provide the communication and blocking between the metering chamber and the interior of the container body. The strength of the flow from the filling material causes the seal valve to move away from the stem (i.e., the material is moved through the housing and is subsequently filled in the container body side) (see Patent Publication 2).

The suggested metering valve mechanisms have an advantage that:

(21) the contents of the metering chamber is propelled to the outer space region through the U-shaped propelling path extending from the outer annular space region to the inner annular space region, thus draining the contents (undiluted solution) in a preferred manner as described above.

(22) Another advantage is that the contents can be filled efficiently in an opposite direction to the propelling direction by a typical contents propelling path including the annular space region around the stem in the housing, for example.

PRIOR ART PATENT DOCUMENT

Patent Publication 1: Japanese Unexamined Patent Application Publication No. 2008-207873 (Japanese Patent No. 5055577)

Patent Publication 2: Japanese Unexamined Patent Application Publication No. 2003-118784 (Japanese Patent No. 4071065)

SUMMARY OF THE INVENTION

Problem to be Solved by the Invention

These suggested metering valve mechanisms according to the applicant of the invention have various advantages including the above (21) and (22).

However, there is a room for improvement in the sealing property between the outer peripheral surface, the inner peripheral surface during the contents filling and the contents propelling annular piston provided in the outer annular space region constituting the metering chamber between the inner housing outer peripheral surface and the outer housing inner peripheral surface.

According to the present invention, inner and outer annular seal sections are provided such that provide the secure sealing action between the inner housing outer peripheral surface and the outer housing inner peripheral surface. The inner and outer annular seal sections are provided in this outer annular space region and are formed at the respective inner and outer ends of the contents-receiving face part of the annular piston receiving the pressure of the contents filled via the inner housing.

This configuration has an objective of preventing the filled contents from being leaked from the respective inner and outer ends of the contents-receiving face part of the annular piston to the propellant-receiving face at the back side to provide the secure isolation between the contents accommodation space regions (metering chamber) at the respective top and back faces of the annular piston and the propellant-accommodating space region.

According to another objective, after the undiluted solution at the lower side of the gas phase section of the outer annular space region (outer metering chamber) is allowed to flow into the outer space region along the U-shaped propelling path, for example, the propellant of the gas phase section is propelled to thereby drain the undiluted solution in a preferred manner.

According to another objective, the contents are efficiently filled through the path of the stem followed by the inner annular space region of the inner housing.

Means for Solving the Problem

The present invention solves the above-described disadvantage in the manner as described below.

(1) A metering valve mechanism of an aerosol container in which, a stem (e.g., a stem 6 (which will be described later)) accommodated in an inner housing (e.g., an inner housing 3 (which will be described later)) is caused to shift from a stationary mode in which the stem is biased by the first elastic member (e.g., an upper coil spring 6*g* (which will be described later)) to a propelling mode against the stationary mode to thereby allow the stem to have a contents inflow-side valve action to a metering chamber formation seal valve (e.g., a seal valve 7 (which will be described later)). This causes a shift from a communication state to a closed state of a metering chamber (e.g., a metering chamber A (which will be described later)) consisting of the inner housing and an outer housing at the outer side (e.g., an outer housing 4 (which will be described later)) and a contents accommodation space region at the upstream side thereof (e.g., a sheath-like space region D, inner bag 5 (which will be described later)). The contents outflow-side valve action of the stem causes the inner housing and a stem path (e.g., a longitudinal center path section 6*a* (which will be described later)) to shift from the closed state to the communication state.

The inner housing consists of:

a tube-like section (e.g., a large diameter body section 3*a* and a small diameter lower section 3*d* (which will be described later)) that is provided to surround the stem and that sets an inner annular space region (e.g., an inner annular space region C (which will be described later)) as the metering chamber between the inner peripheral surface thereof and the outer peripheral surface of the stem.

The outer housing consists of:

a sheath-like section (e.g., a joint sheath-like section 4*h* (which will be described later)) that is provided at the outer side of the inner housing and that sets an outer annular space region (e.g., an outer annular space region B (which will be described later)) as the metering chamber between the inner peripheral surface thereof and the outer peripheral surface of the inner housing and an annular ceiling part (e.g., a joint cover 4*a* (which will be described later)) that has the inner and outer communication holes (e.g., an upper longitudinal hole 4*f* (which will be described later)) to correspond to the outer annular space region.

The outer annular space region consists of:

the first face part (e.g., the lower face part of the annular piston 8 (which will be described later)) that receives the pressure action by to-be-propelled contents filled via the stem path and the inner housing and the second face part (e.g., the upper face part of the annular piston 8 (which will be described later)) that receives the pressure action by the propellant at the back side thereof via the inner and outer communication holes.

At least an end of the first face part has an annular piston (e.g., an annular piston 8 (which will be described later)) that has the first inner annular seal section (e.g., an inner lower-side inverse skirt-like section 8*b* (which will be described later)) providing the sealing action with the outer peripheral surface of the inner housing and the first outer annular seal section (e.g., an outer lower-side skirt-like section 8*d* (which will be described later)) providing the sealing action with the inner peripheral surface of the outer housing.

The seal valve is configured so that:

in a contents filling mode in which the contents are filled via the stem path and the inner housing, the seal valve is moved by the strength of the flow of the filled contents in a direction away from the stem to allow the filled contents to flow into the contents accommodation space region.

(2) In the above (1), the annular piston is configured so that:

an end of the second face part has the second inner annular seal section (e.g., an inner upper-side skirt-like section 8*a* (which will be described later)) providing the sealing action with the outer peripheral surface of the inner housing and the second outer annular seal section (e.g., an outer upper-side inverse skirt-like section 8*c* (which will be described later)) providing the sealing action with the inner peripheral surface of the outer housing.

(3) In the above (1) and (2), the contents accommodation space region is an inner bag having a bag-on valve specification (e.g., an inner bag 5 (which will be described later)) attached to the outer housing side.

(4) In the above (1), (2), and (3), in the propelling mode, the accommodated contents of the metering chamber in the stationary mode are allowed to flow from the upper end side of the inner annular space region to the stem path by a U-shaped path in which the respective lower end sides of the outer annular space region and the inner annular space region are communicated.

The present invention provides a metering valve mechanism of an aerosol container having the configuration as described above and an aerosol type product using this.

EFFECT OF THE INVENTION

The present invention provides the following effects by the above-described configuration.

(31) The filled contents are prevented from being leaked from the respective inner and outer ends of the contents-receiving face part of the annular piston to the propellant-receiving face at the back side to provide the secure isolation between the contents accommodation space regions (metering chamber) at the respective top and back faces of the annular piston and the propellant-accommodating space region.

(32) After the undiluted solution and the like at the lower side of the gas phase section of the outer annular space region (outer metering chamber) is allowed to flow into the outer space region along the U-shaped propelling path, the propellant of the gas phase section is propelled to thereby drain the undiluted solution in a preferred manner.

(33) The contents are efficiently filled through the path of the stem followed by the inner annular space region of the inner housing.

EMBODIMENT FOR CARRYING OUT THE INVENTION

Figure 1:
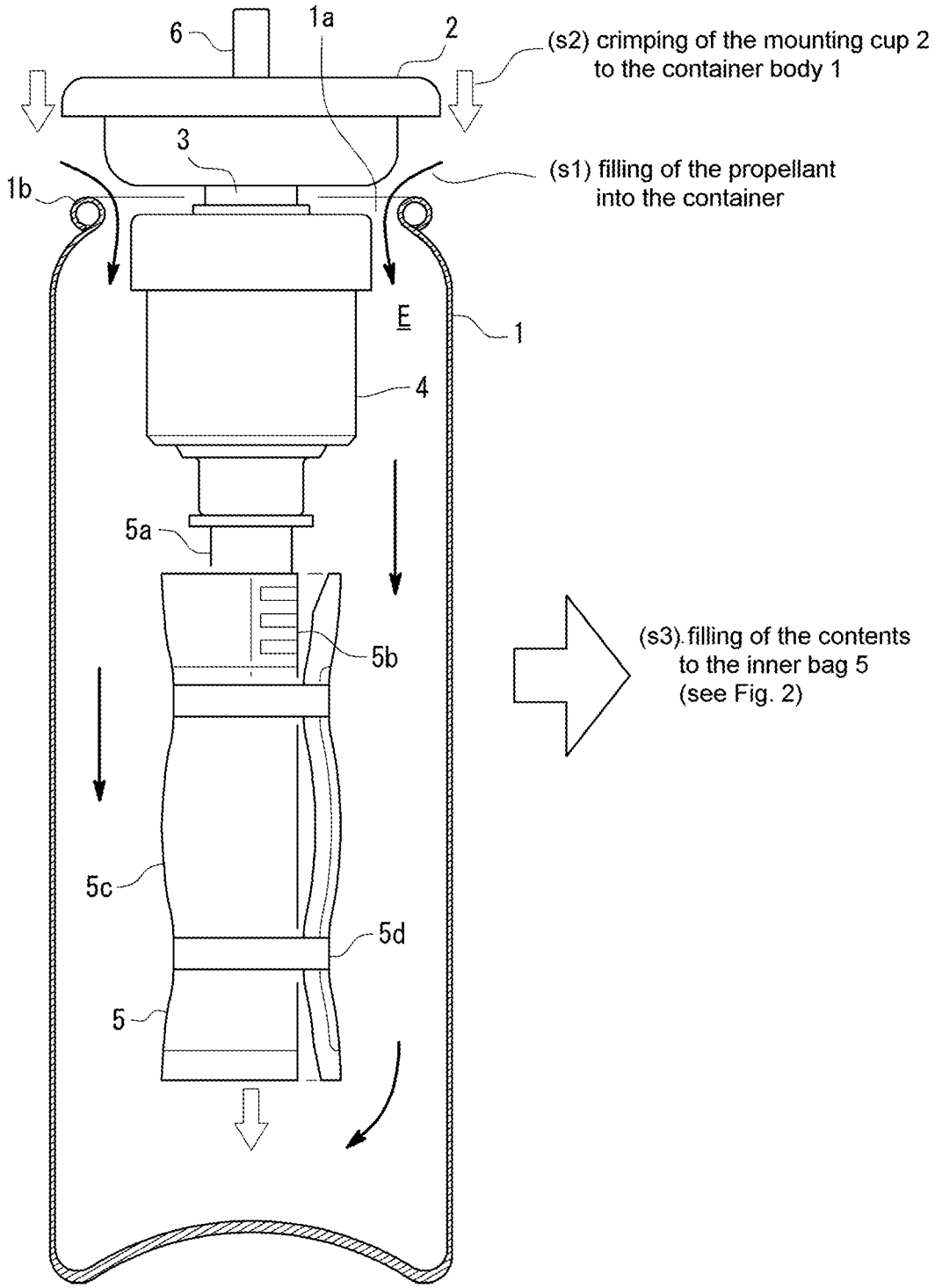
FIG. 1 illustrates the outline of the crimp processing of the undercup filling of the propellant into the aerosol container followed by a container body attachment crimp of a BOV mechanism (mounting cup).

With reference to FIG. 1 to FIG. 4, the following section will describe an embodiment of the present invention.

The following components shown with the alphabetical reference numerals (e.g., a large diameter body section 3*a*) show in principle that the component constitutes a part of a component having the reference numeral (e.g., an inner housing 3).

In FIG. 1-FIG. 4, the reference numeral 1 denotes a container body having an upper opening that constitutes an aerosol type product to accommodate to-be-propelled contents and compressed gas as propellant, for example.

The reference numeral 1*a* denotes an opening section at the center of the container body corresponding to the setting range of a mounting cup 2 (which will be described later). The reference numeral 1*b* denotes an annular bead section to which the mounting cup 2 (which will be described later) is attached by a crimp processing.

The reference numeral 2 denotes a mounting cup attached to the upper opening of the container body 1.

The reference numeral 3 denotes a tube-like inner housing (large diameter body section 3*a*+small diameter lower section 3*d*) that is engaged with a mounting cup 2 to accommodate a stem 6 (which will be described later) and that constitutes the downstream-side space region (inner annular space region C) of a metering chamber A itself (which will be described later).

The reference numeral 3*a* denotes a large diameter body section that is the upper part of the inner housing 3 and that functions as a typical housing part to accommodate an upper coil spring 6*g* to upwardly bias the stem 6.

The reference numeral 3*b* denotes the total of six longitudinal rib-like sections each of which is formed on the inner peripheral surface of large diameter body section 3*a* to form an L-like shape facing the inner side at the lower end-side.

The reference numeral 3*c* denotes the total of five longitudinal slit-like sections to fill the propellant. The longitudinal slit-like sections are formed in the up-and-down direction of the upper end-side outer peripheral surface of the large diameter body section 3*a*.

The reference numeral 3*d* denotes a small diameter lower section that is integrated at the lower end-side of the large diameter body section 3*a* and that functions as a contents inflow path to the inner housing 3.

The reference numeral 3*e* denotes an outwardly-widen lower end-side inner peripheral surface that has an outwardly-widen form at the inner side of the lower end of the small diameter lower section 3*d* and that is used to secure an upward contents path region between the lower end-side seal outer peripheral surface 6*d* of a stem 6 (which will be described later) in the stationary mode of FIG. 3 and the outer peripheral surface longitudinal path section 6*c*.

The reference numeral 3*f* denotes the total of four inner and outer notch-like parts that are formed at the lower end annular part of the tube-like section consisting of the outwardly-widen lower end-side inner peripheral surface 3*e* and that are formed in the diameter direction to allow the contents to pass therethrough.

The reference numeral 4 denotes an outer housing (joint cover 4*a*+joint sheath-like section 4*h*) that is attached to the inner housing 3 to form, between the outer peripheral surface and the inner peripheral surface of the inner housing, the upstream-side space region (outer annular space region B) of a metering chamber A (which will be described later).

The reference numeral 4*a* denotes a joint cover that is engaged with the outer peripheral surface part of the inner housing 3 to form the annular ceiling part of the outer housing 4 and that partially has an upper longitudinal hole 4*f* (which will be described later).

The reference numeral 4*b* denotes an inner peripheral surface annular concave section that is formed in the outer inner peripheral surface of the joint cover 4*a* to be engaged with the upper end-side outer peripheral surface of a joint sheath-like section 4*h* (which will be described later).

The reference numeral 4*c* denotes an outer annular concave section having a lower opening that is formed at the outer end side of the joint cover 4*a* to be engaged with a joint sheath-like section 4*h* (which will be described later).

The reference numeral 4*d* denotes an annular raised section that is formed at the inner end of the joint cover 4*a* to be engaged with the outer peripheral surface part of the inner housing 3.

The reference numeral 4*e* denotes an inner annular concave section having an upper opening that is set between the outer annular concave section 4*c* and the annular raised section 4*d*.

Figure 4:
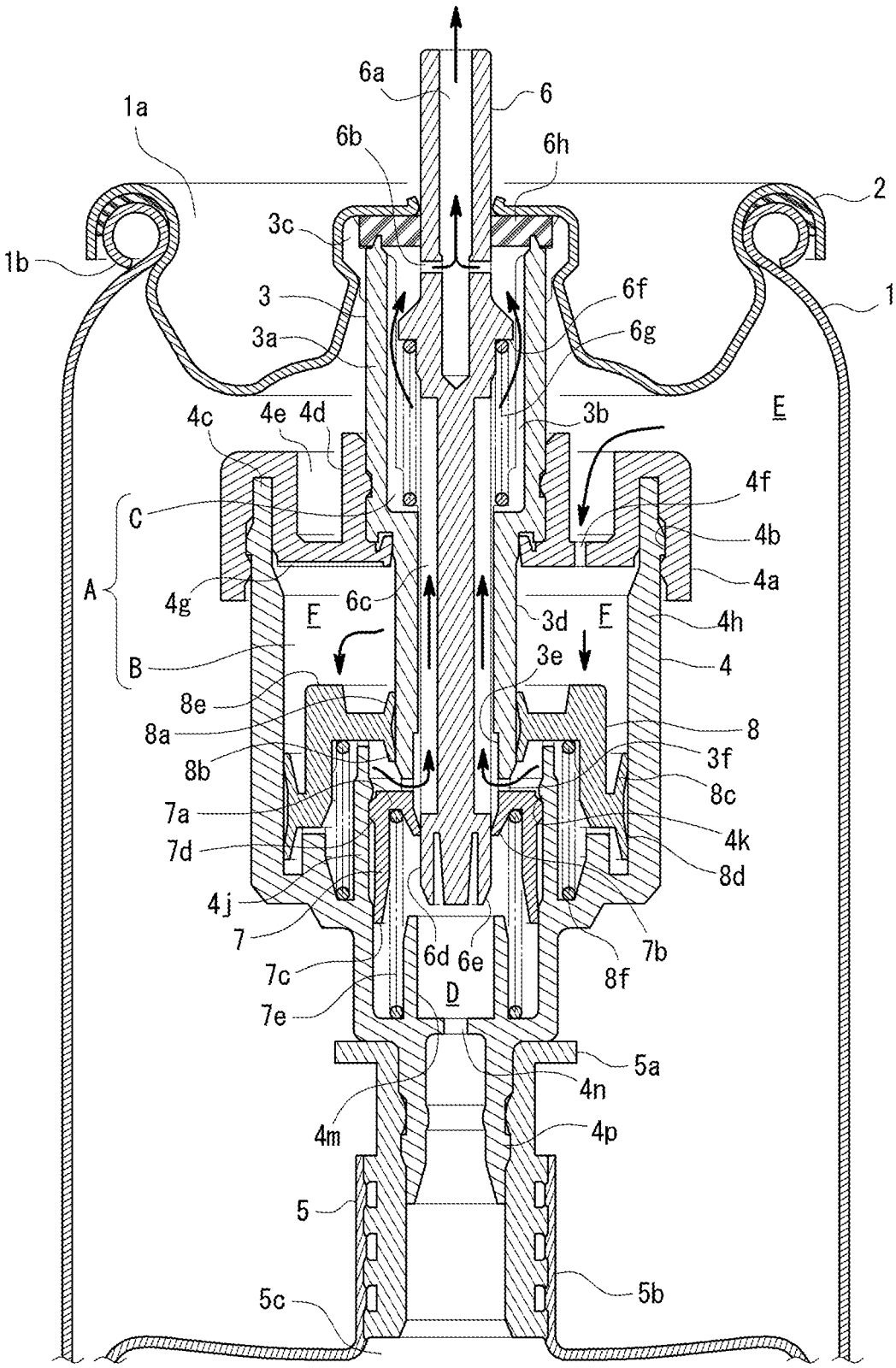
FIG. 4 illustrates a propelling mode corresponding to the stationary mode of FIG. 3.

The reference numeral 4*f* denotes the total of one upper longitudinal hole that is formed in the bottom face part of the inner annular concave section 4*e* of the joint cover 4*a* to allow, in the propelling mode of FIG. 4, the compressed gas and the like existing in the upper space region in the container body 1 to flow thereinto.

The reference numeral 4*g* denotes the total of four diameter direction groove-like sections that are formed in the back part of the bottom face of the inner annular concave section 4*e* to function as a path for the compressed gas and the like between this back part and an annular upper end flat face 8*e* of an annular piston 8 (which will be described later).

The reference numeral 4*h* denotes a joint sheath-like section having an upper opening that is engaged with the outer annular concave section 4*c* to form an outer annular space region B (which will be described later).

The reference numeral 4*j* denotes an upper tube-like raised section that is formed at the inner face at the lower side of the joint sheath-like section 4*h* to use the inner peripheral surface thereof to guide a seal valve 7 (which will be described later) in a sealed manner and that has the outer peripheral surface-side annular concave section accommodating and retaining the lower end part of a lower outer coil spring 8*f* (which will be described later).

The reference numeral 4*k* denotes an inward annular bulging section that is formed on the inner peripheral surface upper end side of the upper tube-like raised section 4*j* to set and retain the seal valve 7 at the uppermost position.

The reference numeral 4*m* denotes a lower tube-like raised section that is formed on the annular bottom face of the joint sheath-like section 4*h* to use the annular concave section at the outer side to accommodate and retain the lower end-side part of a lower inner coil spring 7*e* (which will be described later).

The reference numeral 4*n* denotes a lower longitudinal hole that is formed in the inner bottom face part of the lower tube-like raised section 4*m* to allow the contents to pass therethrough when the contents are filled in the housing of an inner bag 5 (which will be described later) (see FIG. 2) and when the contents are allowed to flow from the inner bag 5 to the metering chamber A (see FIG. 4), for example.

The reference numeral 4*p* denotes a lower end tube-like section that has a diamond-shaped cross section continuing at the immediate upstream side (the contents inflow side) of the lower longitudinal hole 4*n*, for example, and that has an outer peripheral surface to which an inner bag 5 (which will be described later) is welded.

Figure 2:
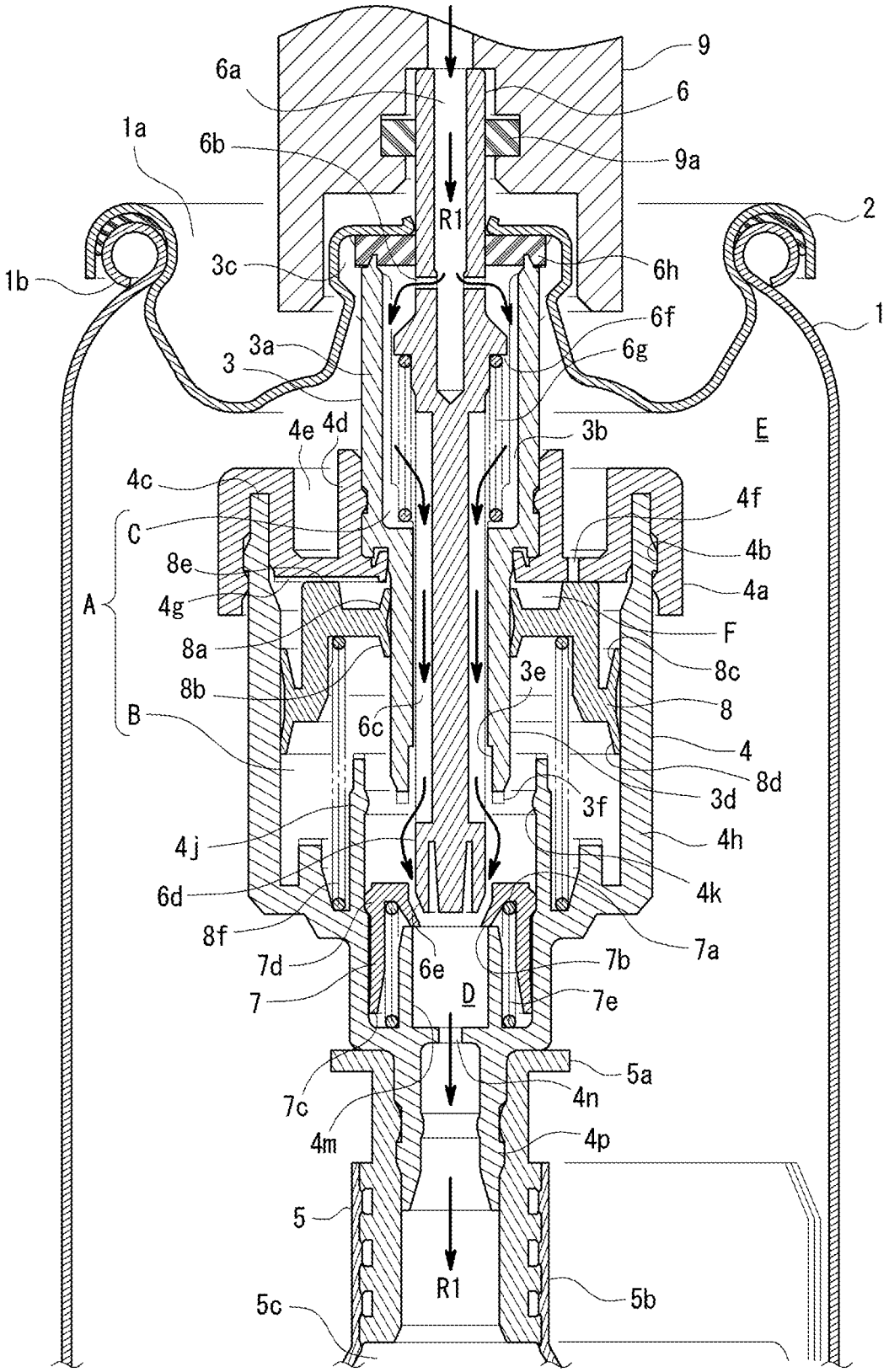
FIG. 2 illustrates the contents filled in the BOV (Bag-On-Valve) inner bag after the crimp processing of FIG. 1.

The reference numeral 5 denotes an inner bag having the well-known shape that is a component of the BOV and that has an internal space region to which to-be-propelled contents are filled (see FIG. 2).

The reference numeral 5*a* denotes a tube-like inner bag joint that is engaged and retained with the outer peripheral surface of the lower end tube-like section 4*p* of the outer housing 4 while the upper opening-side inner peripheral surface of the inner bag 5 is welded.

The reference numeral 5*b* denotes an upper end tube-like opening section that is welded at the upper end inner peripheral surface of the inner bag 5 and at the outer peripheral surface of the inner bag joint 5*a*.

The reference numeral 5*c* denotes a bag-like section that extends from the upper end tube-like opening section 5*b* to the lower side to function as an accommodation space region of to-be-propelled contents and that is set in a double-folded state in the circumferential direction until the contents filling mode of FIG. 2 is reached.

The reference numeral 5*d* denotes a string-like section that retains the bag-like section 5*c* in the double-folded state by the upper part and the lower part wound around the bag-like section 5*c*.

The reference numeral 6 denotes a stem that is attached to the well-known operation button (not shown) to provide a valve action to propel the contents.

The reference numeral 6*a* denotes a sheath-like longitudinal center path section formed in the stem 6 in the up-and-down direction.

The reference numeral 6*b* denotes a lateral hole providing the communication between the longitudinal center path section 6*a* and the outer side of the stem.

The reference numeral 6*c* denotes the total of four outer peripheral surface longitudinal path sections having a groove-like shape in the up-and-down direction that are formed in the outer peripheral surface at the lower side of the stem 6, respectively.

The reference numeral 6*d* denotes a lower end-side seal outer peripheral surface that is a lower end-side part extending at the lower side of the outer peripheral surface longitudinal path section 6*c* of the stem 6 and that is closely abutted to the inverse skirt-like section 7*b* of a seal valve 7 (which will be described later) in the propelling mode of FIG. 4.

The reference numeral 6*e* denotes an outer periphery tapered face having the inward inclination in the lower direction that is formed at the lower end of the lower end-side seal outer peripheral surface 6*d* and that is set, in the stationary mode of FIG. 3, to be opposed to the outer peripheral surface of an inverse skirt-like section 7*b* (which will be described later) to have a distance therebetween.

The reference numeral 6*f* denotes the downward annular step formed in the outer peripheral surface of the lateral hole 6*b* at the lower side.

The reference numeral 6*g* denotes an upper coil spring that is provided between the annular bottom face part of the longitudinal rib-like section 3*b* and the downward annular step 6*f* of the stem 6 to bias the stem 6 in the upward direction in the drawing.

The reference numeral 6*h* denotes an annular stem gasket that is sandwiched between the inner end-side ceiling face of the mounting cup 2 and the upper end face of the inner housing 3 to use the up-and-down motion of the stem 6 to open or close a space between the lateral hole 6*b* and (the inner annular space region C) of a metering chamber A (which will be described later).

The reference numeral 7 denotes a tube-like seal valve that is provided in a sheath-like space region D (which will be described later) and that opens or closes the space between the metering chamber A and the upstream-side space region (sheath-like space region) in accordance with the position of the stem 6 during the up-and-down motion in the stationary mode of FIG. 3 and the propelling mode of FIG. 4.

The reference numeral 7*a* denotes a downward annular groove-like top section that is provided at the upper end side of the seal valve 7 and that retains the upper end part of a lower inner coil spring 7*e* (which will be described later).

The reference numeral 7*b* denotes an elastically-deformable inverse skirt-like section that is continuously formed at the inner end of the annular groove-like top section 7*a* and that is caused, in accordance with the up-and-down motion of the stem 6, to move to have a contact with or to move away from the lower end-side seal outer peripheral surface 6*d* and the outer periphery tapered face 6*e* at the immediate lower side thereof. The reference numeral 7*c* denotes an elastically-deformable skirt-like section that is formed at the outer lower end-side of the seal valve 7 and that is set in the closely-abutted state with the lower continuous inner peripheral surface of the upper tube-like raised section 4*j* when in the contents filling mode (see FIG. 2) in which this seal valve is downwardly moved by the pressure action by the filled contents, for example.

The reference numeral 7*d* denotes an outward annular bulging section that is configured, in the stationary mode (see FIG. 3) and the BOV metering propelling mode (see FIG. 4), to be engaged with the inward annular bulging section 4*k* of the upper tube-like raised section 4*j* to set and retain the seal valve 7 elastically biased by a lower inner coil spring 7*e* (which will be described later) at the uppermost position.

The reference numeral 7*e* denotes a lower inner coil spring that is provided between the outer bottom face part of the lower tube-like raised section 4*m* and the annular groove-like top section 7*a* of the seal valve 7 to bias this seal valve in the upper direction in the drawing.

The reference numeral 8 denotes an annular piston for setting a metering chamber that is provided in an outer annular space region B (which will be described later) and that is moved in the up-and-down in the sealed state with the outer peripheral surface of the inner housing 3 and the inner peripheral surface of the joint sheath-like section 4*h*, respectively.

The reference numeral 8*a* denotes an elastically-deformable inner upper-side skirt-like section that provides the sealing action with the outer peripheral surface of the inner housing 3.

The reference numeral 8*b* denotes an elastically-deformable inner lower-side inverse skirt-like section that provides the sealing action as in the inner upper-side skirt-like section 8*a*.

The reference numeral 8*c* denotes an elastically-deformable outer upper-side inverse skirt-like section that provides the sealing action with the inner peripheral surface of the joint sheath-like section 4*h* (outer housing 4).

The reference numeral 8*d* denotes an elastically-deformable outer lower-side skirt-like section that provides the sealing action as in the outer upper-side inverse skirt-like section 8*c*.

Figure 3:
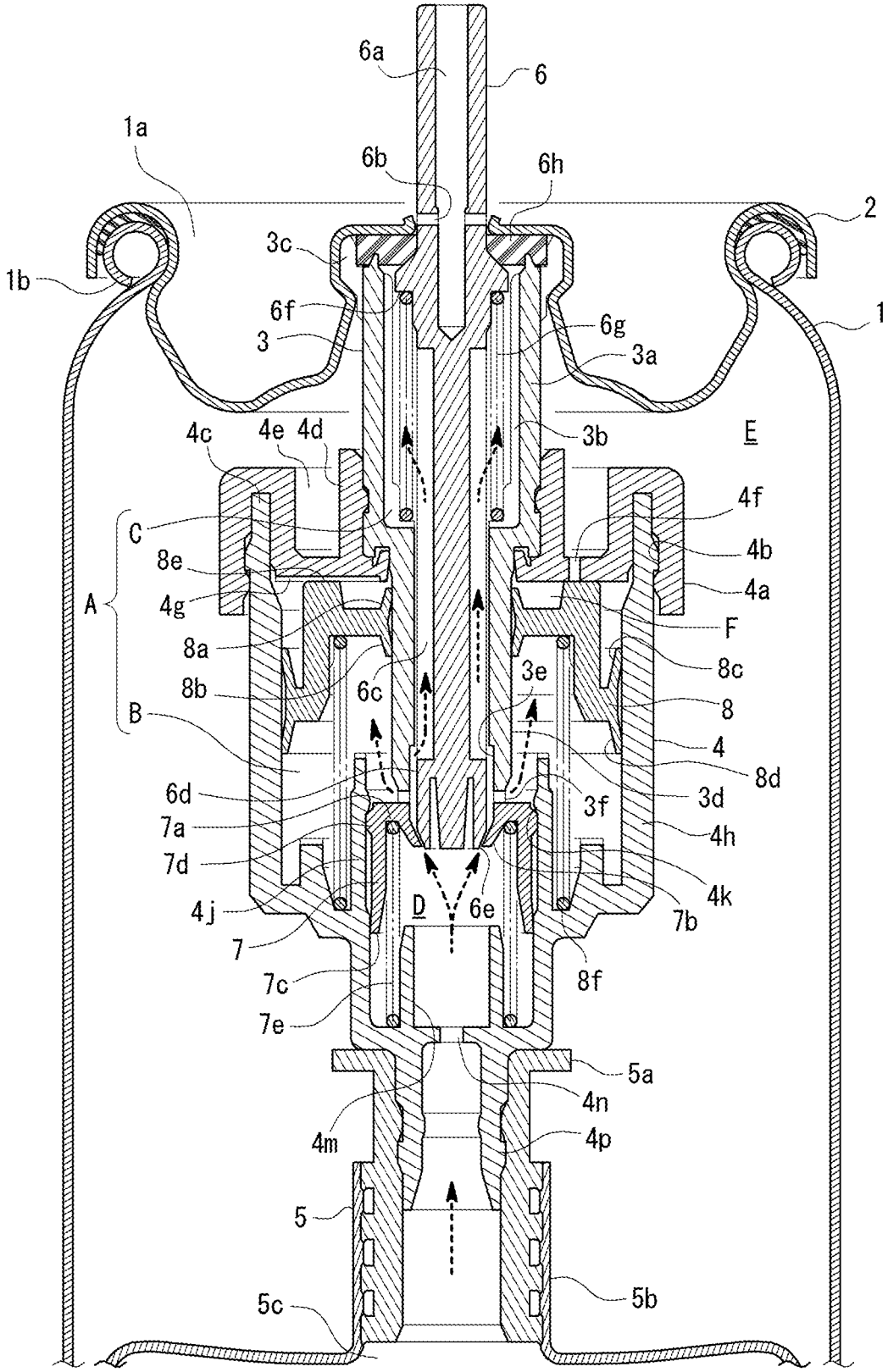
FIG. 3 illustrates the stationary mode of the BOV metering valve mechanism after the contents are filled in the inner bag of FIG. 2.

The reference numeral 8*e* denotes an annular upper end flat face that is abutted to the back part of the bottom face of the inner annular concave section 4*e* (joint cover 4*a*) to thereby set the uppermost motion position of the annular piston 8 in the stationary mode of FIG. 3.

The reference numeral 8*f* denotes a lower outer coil spring that is provided between the outer peripheral surface-side annular concave section of the upper tube-like raised section 4*j* of the joint sheath-like section 4*h* and the inner ceiling face of the annular piston 8 to bias this annular piston in the upward direction.

In FIG. 2, the reference numeral 9 denotes the well-known filling head to fill the contents into the container body 1 from the upper side of the stem 6.

The reference numeral 9*a* denotes an annular seal section that is closely abutted to the outer peripheral surface of the stem 6 in the shown contents filling mode.

The reference numeral A denotes a metering chamber (outer annular space region B+inner annular space region C) set between the contents inflow-side seal valve 7 and the contents outflow-side stem gasket 6*h*.

The reference numeral B denotes an annular space region that constitutes the upstream side of the metering chamber A itself and that is set with the outer peripheral surface of the inner housing 3, the inner peripheral surface of the joint sheath-like section 4*h* and the inner ceiling face of the annular piston 8 and the like and that is configured, in the propelling mode of FIG. 4 in which the inverse skirt-like section 7*b* of the seal valve 7 is closely abutted to the lower end-side seal outer peripheral surface 6*d* of the stem 6, for example, to be moved by the downward move of the annular piston 8 from the stationary mode position (see FIG. 3) so that the contents accommodated in the space region are allowed to flow from the inner and outer notch-like part 3*f* to the inner housing 3.

The reference numeral C denotes an inner annular space region that is set with an annular space region of the annular space region constituting the downstream side of the metering chamber A itself (i.e., the inner peripheral surface of the inner housing 3 and the outer peripheral surface of the stem 6) and that is configured, when in the stationary mode of FIG. 3, so that the inverse skirt-like section 7*b* of the seal valve 7 is moved away from the outer periphery tapered face 6*e* of the stem 6, for example, and the communication state between the space region and the lateral hole 6*b* of the stem 6 is blocked by the stem gasket 6*h* and that is configured, when in the propelling mode of FIG. 4, to cause a shift from the move-away state and the communication-blocked state to the closely-abutted state and the communicated state, respectively.

The reference numeral D denotes a sheath-like space region that is a lower internal space region having a cylindrical shape set in the joint sheath-like section 4*h* and that includes therein the seal valve 7.

The reference numeral E denotes a BOV-surrounding space region that is set at the outer side of the BOV mechanism assembled in the container body 1 (or the outer side of the inner bag) and that functions as a propellant accommodation space.

The reference numeral F denotes a propellant annular space that is set between the joint cover 4*a* and the annular piston 8 (or at the upper side of the annular piston 8).

The reference numeral R1 denotes a housing interior filling route for the contents in a filling mode (FIG. 2).

The inner bag 5 and the inner bag joint 5*a* are made of plastic having the same property (e.g., polyethylene).

The container body 1, the inner housing 3, the outer housing 4 and the stem 6 are made of plastic or metal, for example. The mounting cup 2 is made of metal, for example.

The annular piston 8 is made of plastic such as polypropylene or polyethylene or made of rubber or elastomer.

The BOV mechanism is a mechanism in which the respective components of the mounting cup 2, the inner housing 3, the outer housing 4, the inner bag 5 and the stem 6 are assembled.

An aerosol type product including the BOV mechanism in which the contents and propellant are filled is configured, as shown in FIG. 3 (stationary mode), for example, so that the inner bag 5 accommodates the contents and the BOV-surrounding space region E accommodates the propellant. In the case of this configuration, the contents accommodated in the inner bag 5 directly receives the pressure action by the propellant in the BOV-surrounding space region E.

FIG. 1 illustrates the outline of a series of processings of the propellant filling in the container body 1 and the subsequent attachment using a crimp to the container body 1 of the mounting cup 2 (BOV mechanism).

The propellant filling processing itself of FIG. 1 is the well-known "undercup filling."In this filling processing,

(41) The unit of the BOV mechanism attached with the mounting cup 2 is placed in the container body 1 and the container body 1 is subsequently covered with the well-known filling head.

(42) In this covered state, the BOV-surrounding space region E of the container body is filled with the propellant sent from the outer part of the opening section la of the container body 1 (the exterior part of the mounting cup 2 and the outer housing 4) (see s1).

(43) After the propellant is filled, the well-known crimp processing is used to fix the outer end part of the mounting cup 2 to the bead section 1*b* of the container body 1 in a sealed state (see s2).

Even after the propellant is filled and the mounting cup is engaged, the inner bag 5 is retained by the string-like section 5*d* while having the initially-set double-folded form.

FIG. 2 illustrates, after the propellant filling and crimp processing of FIG. 1, how the inner bag 5 is filled with to-be-propelled contents via the housing interior filling route R1 extending from the well-known filling head 9 via the interior of the inner housing 3 and the interior of the outer housing 4, respectively (see s3 of FIG. 1).

The filling head 9 surrounds the upper end-side exposed part of the stem 6. The annular seal section 9*a* is closely abutted to the outer peripheral surface of the stem 6.

The stem 6 is depressed together with the filling head 9. The communication is provided between the longitudinal center path section 6*a* of the stem 6 and the internal space region (inner annular space region C) of the inner housing 3 via the lateral hole 6*b*.

The to-be-propelled contents supplied from the filling head 9 are allowed to flow into the inner bag 5 of the container body 1 via the shown housing interior filling route R1.

Specifically, the to-be-propelled contents supplied from the filling head 9 to the stem 6 are allowed to flow into the inner bag 5 via the following route generally including:

"the longitudinal center path section 6*a*—the lateral hole 6*b*—the internal space region (inner annular space region C) of the large diameter body section 3*a*—the outer peripheral surface longitudinal path section 6*c* of the stem 6—the space between the internal space region (outer annular space region B) of the outer housing 4/the lower end-side seal outer peripheral surface 6*d* of the stem 6 and outer periphery tapered face 6*e* and the inverse skirt-like section 7*b* of the seal valve 7—the lower longitudinal hole 4*n*—the lower end tube-like section 4*p*."

During this, the seal valve 7 is caused to downwardly move by the strength of the downward flow action by the filled contents while resisting the upward elastic force from the lower inner coil spring 7*e*.

The downward move of the seal valve 7 causes the inverse skirt-like section 7*b* to be actively separated from the outer periphery tapered face 6*e* of the stem 6, thereby efficiently providing the contents filling processing to fill the inner bag 5 with the contents via the housing interior.

When the bag-like section 5*c* is swollen due to the contents filled in the inner bag 5, the string-like section 5*d* is cut off.

According to the basic feature of the contents filling mode of FIG. 2, the annular piston 8 is provided in the outer annular space region B to function as the movable ceiling section of the metering chamber A and is configured so that:

(51) the inner peripheral surface side has the elastically-deformable inner upper-side skirt-like section 8*a* and the inner lower-side inverse skirt-like section 8*b* that provide the sealing action with the outer peripheral surface of the inner housing 3, respectively; and

(52) the outer peripheral surface side has the elastically-deformable outer upper-side inverse skirt-like section 8*c* and the outer lower-side skirt-like section 8*d* that provide the sealing action with the inner peripheral surface of the joint sheath-like section 4*h* (outer housing 4), respectively.

As described above, the annular piston 8 is configured so that the seal inner peripheral surface side and the seal outer peripheral surface side have:

(61) the inner lower-side inverse skirt-like section 8*b* and the outer lower-side skirt-like section 8*d* that prevent a situation where the pressure action of the contents filled in the metering chamber A and the bag-like section 5*c* via the housing interior filling route R1 causes the leak and outflow of the filled contents in the upper space region of the annular piston 8 (e.g., the propellant annular space F between the joint cover 4*a* and the annular piston 8 and the upper longitudinal hole 40; and

(62) the inner upper-side skirt-like section 8*a* and the outer upper-side inverse skirt-like section 8*c* that prevent the situation where the propellant filled in the container body 1 is leaked to flow in the space region at the lower side in the drawing of the annular piston 8 (the metering chamber A and the bag-like section 5*c*).

Specifically, the skirt-like section and the inverse skirt-like section of the annular piston 8 have a closely abutting relation with the inner housing 3 and the outer housing 4, respectively, thereby providing the secure sealing between the upper face-side propellant filling region (propellant annular space F) and the lower face-side contents filling region (outer annular space region B).

In the stationary mode of FIG. 3,

(71) the stem 6, the seal valve 7 and the annular piston 8 are moved to the individual uppermost positions by the elastic forces from the upper coil spring 6*g*, the lower inner coil spring 7*e* and the lower outer coil spring 8*f*, respectively;

(72) after the move, the stem 6 is engaged with and retained by the stem gasket 6*h*, the seal valve 7 is engaged with and retained by the lower end face of the inner housing 3 (the lower end face adjacent to the inner and outer notch-like part 3*f*), and the annular piston 8 is engaged with and retained by the annular ceiling face of the joint cover 4*a* (the lower annular face including the diameter direction groove-like section 4*g*), respectively;

(73) The lateral hole 6*b* leading to the outer space region is set in a noncommunication state with the inner annular space region C of the inner housing 3 (i.e., an outflow valve between the metering chamber A and the outer space region at the downstream-side is set in a closed state); and

(74) the outer periphery tapered face 6*e* of the stem 6 (lower end-side seal outer peripheral surface 6*d*) and the inverse skirt-like section 7*b* of the seal valve 7 are set in a separated state (i.e., a contents inflow valve between the sheath-like space region D and the metering chamber A at the downstream side is set in an opened state).

As described above, the metering chamber A in the stationary mode is configured so that the contents inflow valve is opened and the contents outflow valve is closed.

Thus, the metering chamber A is configured so that the contents in the container body 1 are allowed to flow into the outer annular space region B and the inner annular space region C via the following route including:

"a dip tube (not shown)—the lower longitudinal hole 4*n*—the sheath-like space region D—a lower annular region between the outer periphery tapered face 6*e* and the inverse skirt-like section 7*b*—the lower end-side seal outer peripheral surface 6*d* at the immediate upper side as well as an upper annular region between the lower end-side part of the outer peripheral surface longitudinal path section 6*c* and the outwardly-widen lower end-side inner peripheral surface 3*e*, for example."

The contents are allowed to flow into the outer annular space region B via the inner and outer notch-like part 3*f* and are allowed to flow into the inner annular space region C via the outer peripheral surface longitudinal path section 6*c*.

As described above, in the stationary mode of FIG. 3, the metering chamber A is set in the noncommunication state with the outer space region-side longitudinal center path section 6*a* and the lateral hole 6*b*, respectively, and is set in the communication state with the inner bag 5 in the container body 1 (contents filling space region).

When the well-known operation button (not shown) connected to the stem 6 is depressed from the stationary mode position, for example, then a metering BOV mechanism (not shown) allows the stem 6 to correspondingly move to cause a shift from the stationary mode of FIG. 3 to the propelling mode of FIG. 4.

Specifically, the metering chamber A in the propelling mode is configured so that:

(81) the inner annular space region C (metering chamber A) is set in the communication state between the lateral hole 6*b* of the stem 6 and the longitudinal center path section 6*a* (i.e., the contents outflow valve between the metering chamber A and the downstream-side outer space region is shifted to the opened state); and

(82) the lower end-side seal outer peripheral surface 6*d* of the stem 6 and the inverse skirt-like section 7*b* of the seal valve 7 are set in the closely abutted state (i.e., the contents inflow valve between the sheath-like space region D and the downstream-side metering chamber A is shifted to the closed state).

As described above, in the propelling mode of FIG. 4, the metering chamber A is configured, in contrast with the stationary mode of FIG. 3, so that the contents inflow valve is closed and the contents outflow valve is opened.

The valve actions by the inflow valve and the outflow valve causes the compressed gas as propellant to flow from the BOV-surrounding space region E into the upper longitudinal hole 4*f* of the joint cover 4*a*. The pressure action thereof causes the annular piston 8 to downwardly move while resisting the elastic force of the lower outer coil spring 8*f*.

The downward move of the annular piston 8 causes the contents accommodated in the metering chamber A in the stationary mode (the outer annular space region B and the inner annular space region C) to be propelled to the outer space region via the following route of: "the inner annular space region C—the lateral hole 6*b* of the stem 6—the downstream-side longitudinal center path section 6*a*".

The inner housing 3 and the outer housing 4 include a contents metering/propelling route having a U-shaped route including: "a downward upstream part from the annular piston 8 to the bottom face part at the lower side (outer annular space region B)—an inner and outer notch-like part 3*f* from the outer side to the inner side—an upward downstream part from the contents inflow valve to the lateral hole 6*b* of the stem 6 (inner annular space region C."

This U-shaped route has a specific route generally including: "the outer annular space region B at the lower side of the annular piston 8—the inner and outer notch-like part 3*f* of the inner housing 3—the outer peripheral surface longitudinal path section 6*c* of the stem 6—a longitudinal gap region of adjacent longitudinal rib-like sections 3*b* of the inner housing 3—the lateral hole 6*b* of the stem 6—the longitudinal center path section 6*a*."

Specifically, in the propelling mode of FIG. 4, the outer housing contents are allowed by the U-shaped path to propel from the outer annular space region B of the outer housing 4 to the outer space region via the stem 6.

The seal valve 7 is not limited to the above-described shape and structure. Thus, the seal valve 7 can have any configuration so long as the seal valve 7 can function as an inflow valve of the metering chamber A and has a filling path having a sufficient space to the stem 6 when receiving the filled contents sent from the inner housing 3.

Regarding the propellant filling processing, the undercup filling of FIG. 1 may be substituted with another method of crimping the mounting cup 2 of the BOV mechanism to the container body 1 to subsequently send the contents from the well-known filling head to the BOV-surrounding space region E via a filling route exterior to the housing.

According to this filling method, the sealed state is set in which an inflow port to the longitudinal center path section 6*a* of the stem 6 (upper end opening section) is closed. This seal setting prevents to-be filled propellant from flowing from the longitudinal center path section 6*a* to the inner bag 5. The annular seal section 9*a* of FIG. 2 is not provided.

The propellant filling route exterior to the housing generally includes: "a gap part between the center opening section of the mounting cup 2 and the outer peripheral surface of the stem 6—a gap between the stem gasket 6*h* compressed by the propellant pressure in the downward direction in the drawing and the lower face part of the mounting cup at the immediate upper side thereof—the longitudinal slit-like section 3*c* of the inner housing 3."

The BOV mechanism of FIG. 1-FIG. 4 is assembled by a procedure as shown below, for example:

(101) the stem 6 is allows to pass the stem gasket 6*h* and the upper coil spring 6*g* to set this stem 6 in the inner housing 3 from the upper side;

(102) the inner housing 3 of the above (101) is set from the lower side of the mounting cup 2 to crimp the center sheath-like section of the mounting cup 2 to fix the upper end large diameter section of the inner housing 3 to the mounting cup 2;

(103) the lower inner coil spring 7*e* and the seal valve 7 are sequentially set in the upper tube-like raised section 4*j* of the joint sheath-like section 4*h* so that the lower inner coil spring 7*e* and the seal valve 7 are closer to the upper side;

(104) the lower outer coil spring 8*f* and the annular piston 8 are sequentially set in the joint sheath-like section 4*h* of the above (103) from the upper side to fix the joint cover 4*a* to the upper end opening section of the joint sheath-like section 4*h* to provide the outer housing 4;

(105) the outer housing 4 of the above (104) is fixed to the lower section of the inner housing 3 of the above (102) so that small diameter lower section 3*d* passes the annular raised section 4*d*;

(106) the bag-like section 5*c* of the inner bag 5 attached with the inner bag joint 5*a* is bent and is retained by the string-like section 5*d*; and (107) the lower end tube-like section 4*p* of the outer housing 4 is engaged with the inner bag joint 5*a* of the inner bag 5.

Aerosol type products including the above-described metering valve mechanism may be used for various applications such as detergent, cleaning agent, antiperspirant, repellent, insecticide, medicine, quasi-drug, cosmetics, and laundry starch.

The contents accommodated in the aerosol container may have various forms such as a liquid-like form, a cream-like form, or a gel-like form. The contents may include components such as powder-like matters, oil components, alcohols, surfactant, high molecular compounds, active ingredients depending on each application, or water.

Powder-like matters include metal salts powders, inorganic substance powders, or resin powders such as talc, kaolin, aluminum hydroxychloride (aluminum salts), calcium alginate, gold powder, silver powder, mica, carbonate, magnesium chloride, silica, zinc oxide, titanium oxide, zeolite, nylon powder, barium sulfate, cellulose, or the mixtures thereof.

Oil components may include silicone oil such as dimethylpolysiloxane, ester oil such as isopropyl myristate, oils and fats such as palm oil, eucalyptus oil, camellia oil, olive oil, or jojoba oil, hydrocarbon oil such as liquid paraffin, or fatty acid such as myristic acid, palmitic acid, stearic acid, linoleic acid, or linolenic acid.

Alcohols include monohydric lower alcohol such as ethanol, monohydric higher alcohol such as lauryl alcohol or cetanol, or polyalcohol such as ethylene glycol, 1,3-butylene glycol, or glycerin.

Surfactants include anionic surfactant such as sodium lauryl sulfate, nonionic surfactant such as polyoxyethylene alkyl ether or polyglycerin fatty acid ester, amphiprotic surfactant such as lauryldimethylaminoacetic acid betaine, or cationic surfactant such as alkyl trimethylammonium chloride.

High molecular compounds include hydroxyethyl cellulose, methyl cellulose, gelatin, starch, casein, xanthan gum, or carboxyvinyl polymer, for example.

Active components depending on the respective applications include dyes such as paraphenylenediamine or aminophenol, oxidizing agent such as hydrogen peroxide water, set agent such as acrylic resin or wax, ultraviolet absorber such as paramethoxycinnamic acid2-ethylhexyl, vitamin such as retinol or dl-α-tocopherol, moisturizing agent such as hyaluronic acid, anti-inflammatory agent such as methyl salicylate or indometacin, bacteria removing agent such as sodium benzoate or cresol, pest repellent such as pyrethroid or diethyltoluamide, antiperspirant such as zinc para-phenolsulfonate, refrigerants such as camphor or menthol, antiasthmatic agent such as ephedrine or adrenalin, sweetener such as sucralose or aspartame, adhesive agent or coating material such as epoxy resin or urethane, dyes such as paraphenylenediamine or aminophenol, oxidizing agent such as hydrogen peroxide water, or fire extinguisher such as ammonium dihydrogen phosphate, sodium hydrogen carbonate, or potassium.

Furthermore, agents other than the above contents can include suspension, emulsifier, antioxidant, or metal ion sequestering agent, for example.

The propelling gas of aerosol type products includes compressed gas such as carbon dioxide gas, nitrogen gas, compressed air, nitrous oxide, oxygen gas, rare gas, or mixed gas thereof and liquefied gas such as liquefied petroleum gas, dimethylether, or hydrofluoroolefin.

EXPLANATION OF REFERENCE NUMERALS

1: Container body
1*a*: Opening section
1*b*: Bead section
2: Mounting cup
3: Inner housing (large diameter body section 3*a*+small diameter lower section 3*d*)
3*a*: Large diameter body section
3*b*: Longitudinal rib-like section
3*c*: Longitudinal slit-like section
3*d*: Small diameter lower section
3*e*: Outwardly-widen lower end-side inner peripheral surface
3*f*: Inner and outer notch-like parts
4: Outer housing (joint cover 4*a*+joint sheath-like section 4*h*)
4*a*: Joint cover
4*b*: Inner peripheral surface annular concave section
4*c*: Outer annular concave section
4*d*: Annular raised section
4*e*: Inner annular concave section
4*f*: Upper longitudinal hole
4*g*: Diameter direction groove-like section
4*h*: Joint sheath-like section
4*j*: Upper tube-like raised section
4*k*: Inward annular bulging section
4*m*: Lower tube-like raised section
4*n*: Lower longitudinal hole
4*p*: Lower end tube-like section
5: Inner bag having BOV metering propelling specification
5*a*: Inner bag joint
5*b*: Upper end tube-like opening section
5*c*: Bag-like section
5*d*: String-like section
6: Stem
6*a*: Longitudinal center path section
6*b*: Lateral hole
6*c*: Outer peripheral surface longitudinal path section
6*d*: Lower end-side seal outer peripheral surface
6*e*: Outer periphery tapered face
6*f*: Downward annular step
6*g*: Upper coil spring
6*h*: Stem gasket
7: Seal valve
7*a*: Annular groove-like top section
7*b*: Inverse skirt-like section
7*c*: Skirt-like section
7*d*: Outward annular bulging section
7*e*: Lower inner coil spring
8: Annular piston
8*a*: Inner upper-side skirt-like section
8*b*: Inner lower-side inverse skirt-like section
8*c*: Outer upper-side inverse skirt-like section
8*d*: Outer lower-side skirt-like section
8*e*: Annular upper end flat face
8*f*: Lower outer coil spring
9: Filling head
9*a*: Annular seal section
A: Metering chamber (outer annular space region B+inner annular space region C)
B: Outer annular space region
C: Inner annular space region
D: Sheath-like space region
E: BOV-surrounding space region
F: Propellant annular space
R1: Contents housing interior filling route

The invention claimed is:

1. A metering valve mechanism of an aerosol container comprising:

a metering chamber defined by an inner housing and an outer housing located at an outer side of the inner housing;

a stem accommodated in an inner housing, the stem configured to shift from a stationary mode in which the stem is biased by a first elastic member to a propelling mode to thereby transition a metering chamber formation seal valve from an open state to a closed state where communication is closed between the metering chamber and a contents accommodation space region located upstream of the metering chamber; and shift of the stem from the propelling mode to the stationary mode causes communication to close between the inner housing and the stem, wherein the inner housing consists of:

a tube section that is provided to surround the stem and that sets an inner annular space region forming a portion of the metering chamber between the inner peripheral surface thereof and the outer peripheral surface of the stem;

the outer housing consists of:

a sheath section that is provided at the outer side of the inner housing and that sets an outer annular space region forming a portion of the metering chamber; the outer annular space region defined between an inner peripheral surface of the outer housing and an outer peripheral surface of the inner housing; and an annular ceiling part that has an upper longitudinal hole communicating with the outer annular space region;

the outer annular space region consists of:

an annular piston having a first face part that receives pressure from to be-propelled contents and a second face part that receives pressure from propellant via the upper longitudinal hole; and at least an end of the first face part having a first inner annular seal section providing a seal with the outer peripheral surface of the inner housing and a first outer annular seal section providing a seal with the inner peripheral surface of the outer housing, and the seal valve is configured so that:

in a contents filling mode in which the contents are filled via the stem path and the inner housing, the seal valve is moved by the strength of the flow of the filled contents in a direction away from the stem to allow the filled contents to flow into the contents accommodation space region.

2. The metering valve mechanism of an aerosol container according to claim 1, wherein the annular piston is configured so that an end of the second face part has a second inner annular seal section providing a seal with the outer peripheral surface of the inner housing and a second outer annular seal section providing a seal with the inner peripheral surface of the outer housing.

3. The metering valve mechanism of an aerosol container according to claim 1, wherein the contents accommodation space region is an inner bag attached to the outer housing.

4. The metering valve mechanism of an aerosol container according to claim 1, wherein, in the propelling mode, contents accommodated in the metering chamber in the stationary mode are allowed, by a U-shaped path in which respective lower end sides of the outer annular space region and the inner annular space region are communicated to flow from the upper end side of the inner annular space region to the stem path.

5. An aerosol type dispenser including the metering valve mechanism of an aerosol container according to claim 1 and accommodating propellant and contents.

* * * * *